US008695163B2

(12) United States Patent
Roberts

(10) Patent No.: US 8,695,163 B2
(45) Date of Patent: Apr. 15, 2014

(54) DOOR HOLD OPEN ARM ASSEMBLY

(75) Inventor: Edgar E. Roberts, Kings Mountain, NC (US)

(73) Assignee: Yale Security Inc., Monroe, NC (US)

( * ) Notice: Subject to any disclaimer, the term of this patent is extended or adjusted under 35 U.S.C. 154(b) by 166 days.

(21) Appl. No.: 13/174,846

(22) Filed: Jul. 1, 2011

(65) Prior Publication Data

US 2013/0000208 A1 Jan. 3, 2013

(51) Int. Cl.
*E05F 3/00* (2006.01)

(52) U.S. Cl.
USPC ..... 16/49; 16/82

(58) Field of Classification Search
USPC ..... 16/49, 85, 82, 86 C, DIG. 10, DIG. 17, 16/DIG. 21, 71, 72; 49/506; 292/DIG. 19, 292/263
See application file for complete search history.

(56) References Cited

U.S. PATENT DOCUMENTS

| | | | | |
|---|---|---|---|---|
| 1,678,701 | A * | 7/1928 | Moore | 16/49 |
| 2,960,718 | A * | 11/1960 | Lasier | 16/49 |
| 3,259,936 | A * | 7/1966 | Sheridan | 16/49 |
| 3,877,108 | A | 4/1975 | Del Fiacco | |
| 3,909,877 | A | 10/1975 | Christy et al. | |
| 3,911,526 | A | 10/1975 | Christy et al. | |
| D273,457 | S * | 4/1984 | Matsuo et al. | D8/330 |
| 5,551,740 | A * | 9/1996 | Lin et al. | 292/338 |
| 7,444,713 | B2 * | 11/2008 | McKinney et al. | 16/63 |
| 7,721,386 | B2 | 5/2010 | McKinney et al. | |

FOREIGN PATENT DOCUMENTS

| | | | |
|---|---|---|---|
| DE | 3916214 | | 11/1990 |
| DE | 295 17 703 | U1 | 1/1996 |
| DE | 20 2005 019 321 | U1 | 3/2006 |
| EP | 1 707 722 | A1 | 10/2006 |
| GB | 1 332 480 | | 10/1973 |

OTHER PUBLICATIONS

Chabot-Las Positas Community College District, Door Hardware Specification Guideline, Apr. 2008, http://www.clpccd.org/facilities/documents/ChabotLasPositasCCDSpecGuide_Hardware050608.pdf, visited Mar. 11, 2011 (2 pages).

LCN Closers, LCN 4040 Series, www.lcnclosers.com/pdfs/4000-4040.pdf, visited Mar. 11, 2011 (1 page).

European Patent Office, PCT International Search Report and Written Opinion of the International Searching Authority for International Application No. PCT/US2012/044953 date of completion Oct. 8, 2012.

* cited by examiner

*Primary Examiner* — William Miller
(74) *Attorney, Agent, or Firm* — Matthew W. Witsil; Moore & Van Allen PLLC

(57) ABSTRACT

A hold open arm assembly for a door closer to facilitate access to the holding feature by a resiliently biased plunger on a closer arm that is mounted to a soffit plate. A soffit ramp may extend from the soffit plate to provide a sloped surface for engagement by the plunger, leading to the plunger being gradually depressed as the door continues to open and receiving in a recessed area of its free end a rivet head at the soffit plate to hold the door open. When the first arm member pivots relative to the soffit plate and the plunger approaches the head, the plunger engages the sloped surface of the soffit ramp, slides along the sloped surface toward the head, and receives at least a portion of the head in the opening in the free end.

23 Claims, 13 Drawing Sheets

DOOR HOLD OPEN ARM ASSEMBLY

BACKGROUND

Embodiments of a hold open arm assembly described herein relate generally to a door with apparatus for holding the door open, and more particularly to a hold open arm that facilitates the hold open function.

Conventional assemblies include a hold open arm pivotally mounted to a soffit plate that is mounted to the soffit of the door. A spring-biased vertical plunger may be provided that rides on the end of a button head rivet disposed on the soffit plate when the door is in the hold open position. An opening in the end of the plunger ends up resting beneath the head of the rivet. As the plunger approaches the rivet, contact is made between the side of the plunger and the side of the rivet, resulting in lateral force between the two parts, and significant friction as the plunger is forced down the side of the rivet. This may result in excessive wear and/or premature failure of the parts.

For the foregoing reasons, there is a need for a new hold open arm assembly that reduces or avoids failures that may be seen with conventionally designed plungers and rivets.

SUMMARY

In accordance with one embodiment, a soffit ramp for a door hold open assembly including a soffit plate and a plunger is provided. The soffit ramp includes a body distributed around first, second, and third perpendicular, intersecting axes, such that there is a first surface substantially distributed around a plane that includes the first and second axes, and a second surface. The second surface is opposite the first surface, and the distance between the first and second surfaces parallel to the third axis defines a thickness. The second surface defines a channel extending substantially along the first axis, with the channel including a wall on each side and a bottom. The second surface also defines a first sloped surface extending generally in the alignment of the second axis on a first side of the channel from the periphery of the body proximate to the first surface where the thickness is relatively small, to the wall of the channel where the thickness of the body is relatively large.

In accordance with another embodiment, a hold open arm assembly is provided for a door mounted to a door frame including a soffit. The door is urged to close by a door closer mounted to the door. The assembly includes a soffit plate substantially distributed about a major plane and adapted to be mounted to the soffit, and a holding feature including a head, with the holding feature mounted to the soffit plate such that the head extends substantially perpendicularly from the major plane. A soffit ramp extends from the soffit plate in a direction away from the major plane. The soffit ramp provides a sloped surface laterally on at least one side of the head, and the distance from the sloped surface to the major plane is greatest proximate to the head. A first arm member has a longitudinal axis, a proximal end, and a distal end, where the proximal end of the first arm member is pivotally mounted to the soffit plate. A housing is mounted to the first arm member, and a resiliently biased plunger having a free end is received in the housing. The plunger extends substantially perpendicularly to the longitudinal axis and defining a recessed area in the free end. A second arm member has a proximal end and a distal end, and the proximal end of the second arm member is pivotally mounted to the distal end of the first arm member and the distal end is adapted to be pivotally mounted to the door closer. When the first arm member pivots relative to the soffit plate and the plunger approaches the head, the plunger engages the sloped surface of the soffit ramp, slides along the sloped surface toward the head, and receives at least a portion of the head in the opening in the free end.

In accordance with another embodiment, a method of operating a door is provided. The door is mounted to a door frame including a soffit and is operatively connected to a door closer. A soffit plate is mounted to the soffit, a first arm is pivotally mounted to the soffit plate, a resiliently biased plunger is mounted to the first arm and defines a recessed area in a free end, a second arm is pivotally mounted to the first arm and to the door closer, and a soffit ramp extends downward from the soffit plate. The soffit ramp includes a sloped surface and a holding feature with a head adjacent to the sloped surface. The method includes pushing the door open in a first direction until the plunger engages the sloped surface of the soffit ramp, and continuing to push the door in the first direction. The plunger is caused to be increasingly depressed as the plunger slides along the sloped surface, until the plunger engages the head and receives the head in the recessed area to hold the door open.

BRIEF DESCRIPTION OF THE DRAWINGS

For a more complete understanding, reference should now be had to the embodiments shown in the accompanying drawings and described below. In the drawings.

DESCRIPTION

The embodiments of a hold open arm assembly described herein may be for use with a conventional door closer, including, for example, a spring and a hydraulic cylinder. Moreover, it is understood that the overall construction of the door closer is not critical. Accordingly, although exemplary embodiments will be described in detail herein with respect to a door closer function, detailed explanations of the functioning of the door closer components are deemed unnecessary for understanding by one of ordinary skill in the art.

Certain terminology is used herein for convenience only and is not to be taken as a limitation. For example, words such as "upper," "lower," "left," "right," "horizontal," "vertical," "upward," and "downward" merely describe the configuration shown in the figures. The components may be oriented in any direction and the terminology, therefore, should be understood as encompassing such variations unless specified otherwise.

Figure 1:
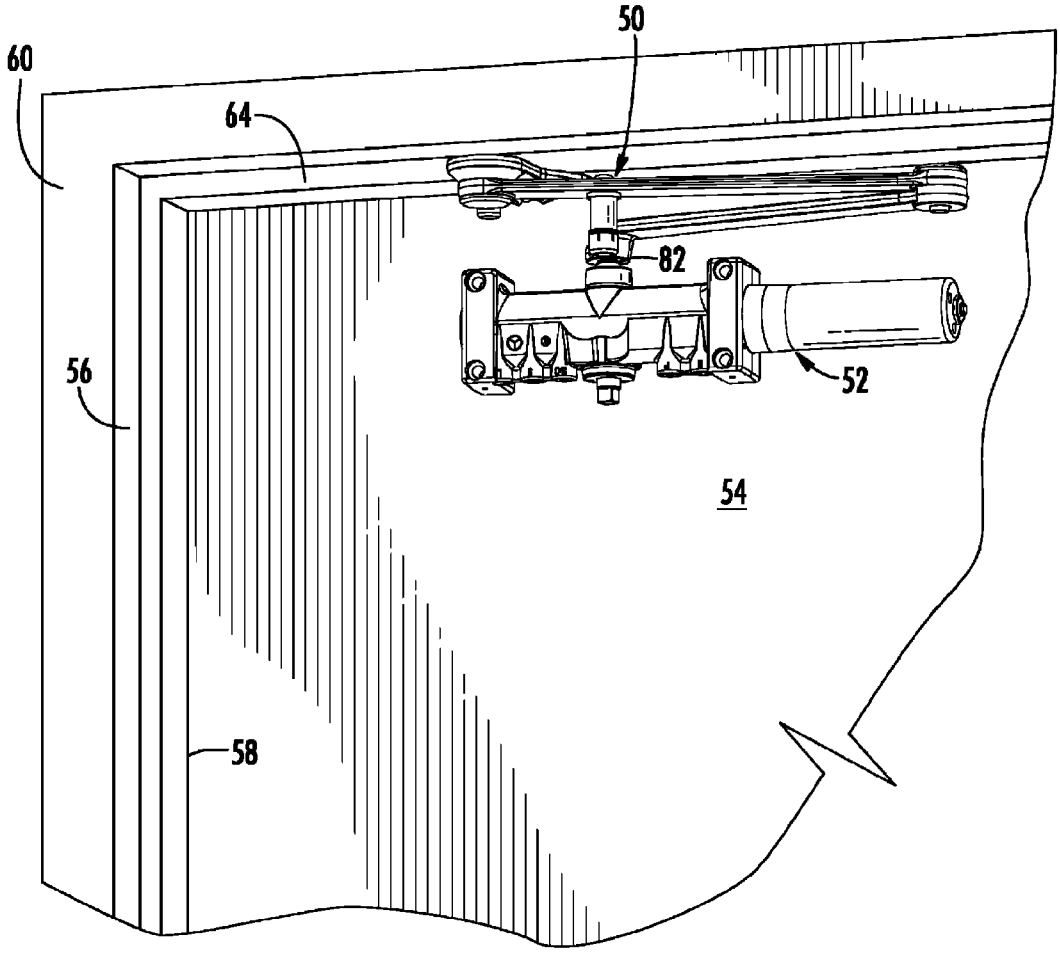
FIG. 1 is a perspective view of a door closer with an embodiment of a hold open arm assembly installed on a door with the door closed.
Figure 2:
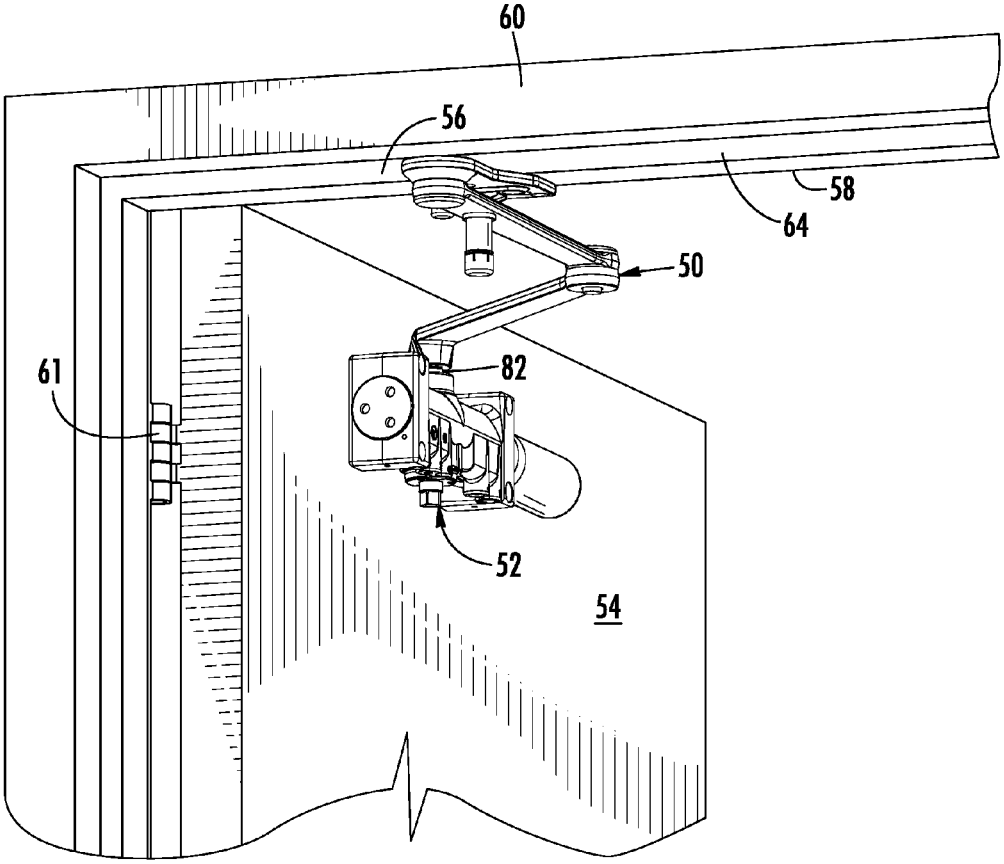
FIG. 2 is a perspective view of the door closer and hold open arm assembly of FIG. 1 with the door open.
Figure 3:
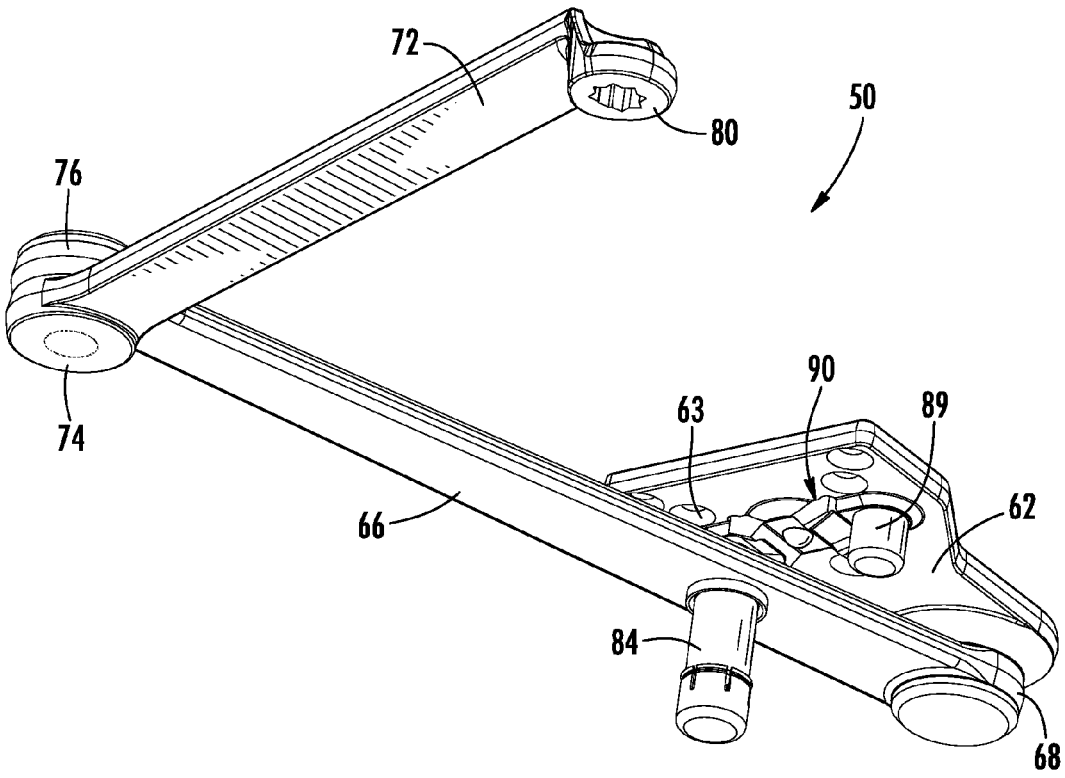
FIG. 3 a perspective view of the hold open arm assembly of FIG. 1.
Figure 4:
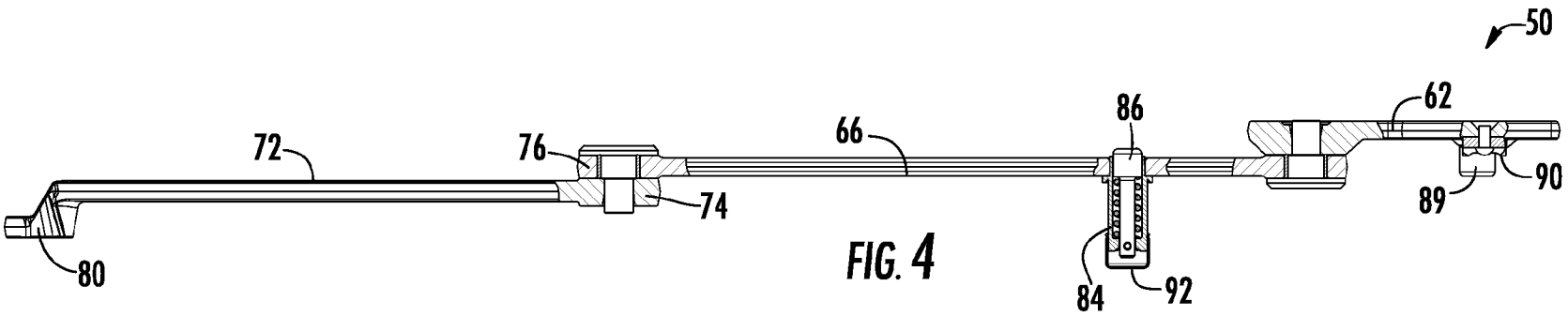
FIG. 4 is a side elevation view of the hold open arm assembly of FIG. 1.
Figure 5:
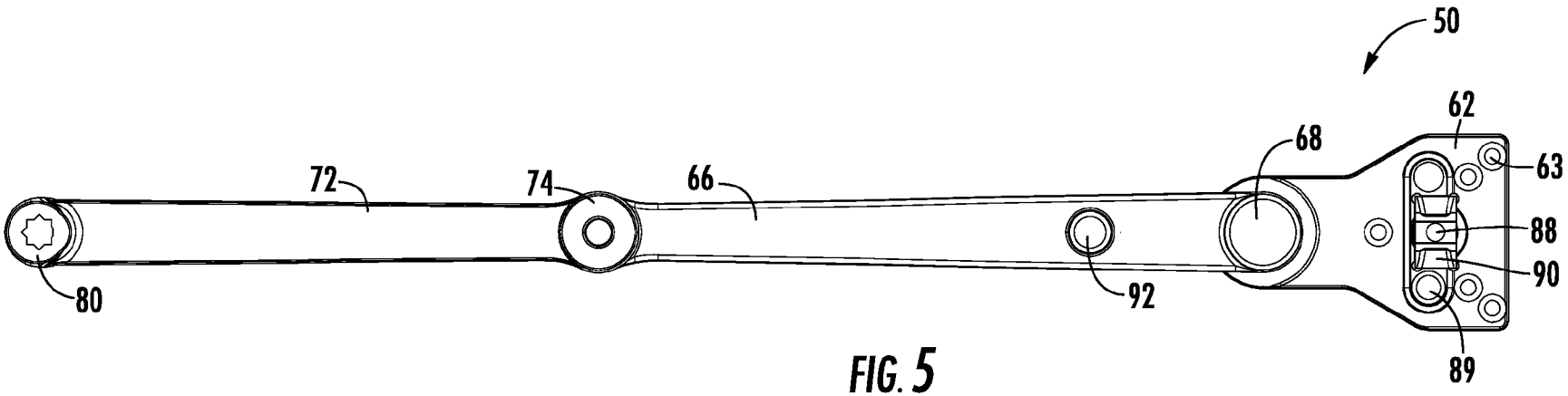
FIG. 5 is a bottom plan view of the hold open arm assembly of FIG. 1.

Referring now to the drawings, wherein like reference numerals designate corresponding or similar elements throughout the several views, an embodiment of a hold open assembly for use with a conventional closing and holding open of a door is shown in FIGS. 1 and 2 and is generally designated at 50. The assembly 50 is applied to a door closer 52 that is mounted to a door 54, the door 54 being pivotally mounted to a frame 56 at an opening 58 in a wall 60 with hinges 61. The assembly 50, as shown in FIGS. 3-5, includes a soffit plate 62 with mounting holes 63 for attaching the soffit plate 62 to the soffit 64, a first arm 66 with a proximal end 68 mounted to the soffit plate 62, and a second arm 72 with a proximal end 74 mounted to the distal end 76 of the first arm 66. The distal end 80 of the second arm 72 is mounted to the driving shaft 82 of the door closer 52 (FIG. 1).

A housing 84 is mounted to the first arm 66 substantially perpendicularly to the longitudinal axis of the first arm 66. A plunger 86 is disposed in the housing 84. The assembly 50 further includes a holding feature, shown as a rivet 88, a stop 89 mountable to the soffit plate 62 on either side of the rivet 88 for preventing movement of the door past a set angle, and a soffit ramp 90. The soffit ramp 90 is mounted to the bottom side of the soffit plate 90.

Figure 6:
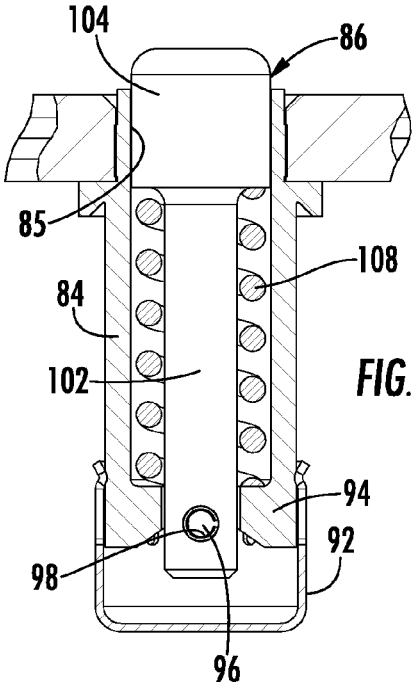
FIG. 6 is a cross-section view of an embodiment of a plunger assembly of the hold open arm assembly of FIG. 1.
Figure 7:
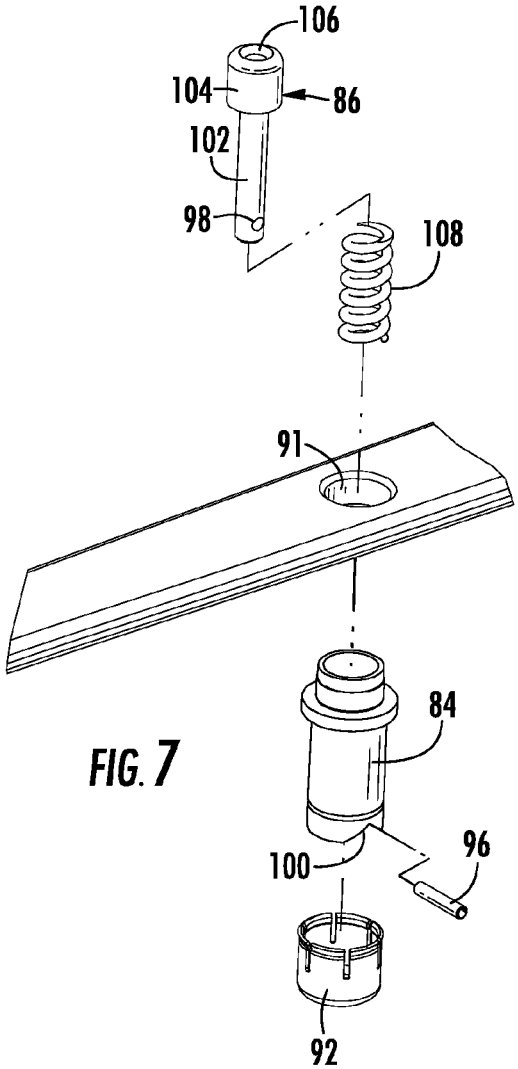
FIG. 7 is an exploded perspective view of the plunger assembly of FIG. 6.

FIGS. 6 and 7 detail the embodiments of the plunger 86 and housing 84. The housing 84 is mounted in an opening 91 in the first arm 66. The housing 84 may be substantially cylindrical and hollow, with an end cap 92 closing the free end, at which there is an end wall 94 through which the plunger 86 may slide. A roll pin 96 may be provided to prevent turning of the plunger 86 relative to the housing 84, with the roll pin 96 passing through an opening 98 in the plunger 86 and being disposed in a notch 100 on each side of the housing 84. The plunger 86 has a shaft 102 with an enlarged end 104 distal from the end cap 92. A recessed area 106 is provided at the end of the enlarged end 104. A spring 108 may be provided to resiliently bias the plunger 86 outwardly from the housing 84. The spring 108 urges the plunger 86 outward by applying force to the end wall 94 of the housing and the inner surface of the enlarged end 104 of the plunger 86.

Figure 8:
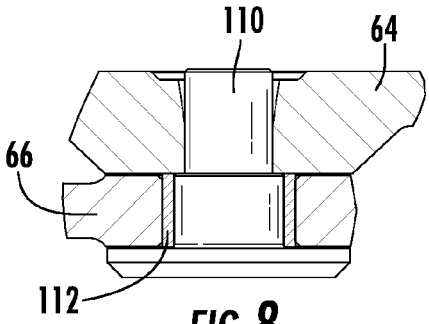
FIG. 8 is a partial section view of the connection of a soffit plate to an arm of the hold open arm assembly of FIG. 1.

The pivotal connection of the first arm 66 to the soffit plate 62 is shown in FIG. 8. Openings in each part 66, 62 are aligned and a stud 110 is riveted in place. A sleeve bearing 112 is provided in the opening in the first arm 66. The pivotal connection between the first arm 66 to the second arm 72 is made similarly.

Figure 9:
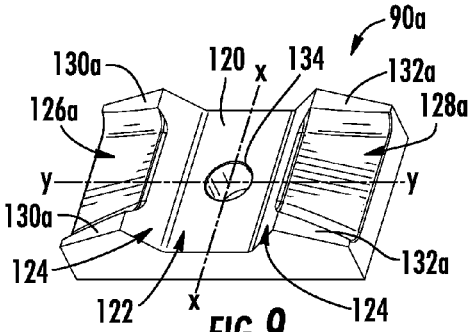
FIG. 9 is a perspective view of a first embodiment of a soffit ramp of the hold open arm assembly of FIG. 1.
Figure 10:
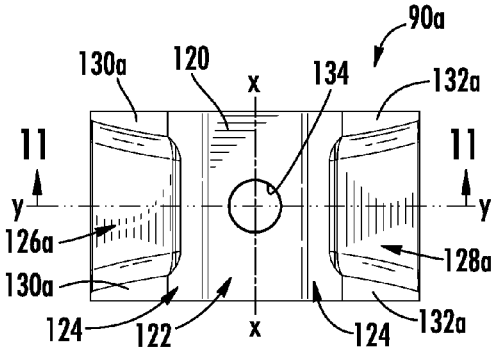
FIG. 10 is a top plan view of the soffit ramp of FIG. 9.

In the embodiment shown, the rivet 88 (FIGS. 3 and 4) secures the soffit ramp 90 in place on the bottom surface of the soffit plate 62. FIGS. 9 and 10 show a first embodiment of a soffit ramp 90*a*. The soffit ramp 90*a* includes a central channel 120 along its minor longitudinal axis X-X with a bottom 122 and two walls 124. Opposing sloped surfaces 126*a*, 128*a* are provided along the major longitudinal axis Y-Y, where the soffit ramp 90*a* is thinner at its periphery. The thickness of the soffit ramp 90*a* increases as the minor axis is approached, until the channel 120 is reached. Ridges 130*a*, 132*a* provide a boundary and additional material strength at the sides of the sloped surfaces 126*a*, 128*a* and are shaped symmetrically about the major axis Y-Y such that the soffit ramp 90*a* may be mounted to the soffit plate 62 in either of two directions in which the minor axis is coincident with the longitudinal axis of the soffit plate 62. A central opening 134 is provided to receive the holding feature, or rivet 88, which serves to fasten the soffit ramp 90*a* to the soffit plate 62 and to provide a head that is received in the opening in the free end of the plunger 86.

Figure 11:
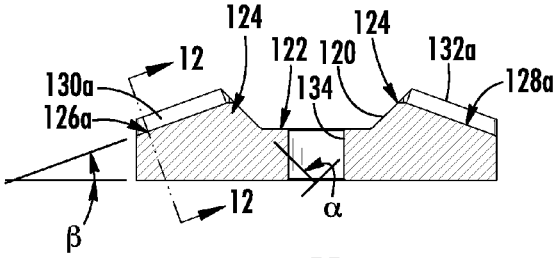
FIG. 11 is a section view of the soffit ramp of FIG. 9 taken along line 11-11 of FIG. 10.

FIG. 11 shows a section view of the soffit ramp 90*a*. The walls 124 of the channel 120 are outwardly sloped such that their extended surfaces form an angle $\alpha$, in this case approximately 90 degrees. The outward slope of the channel walls 124 impacts the points of contact of the plunger 86 with the rivet 88 and the end of the sloped surfaces 126*a*, 128*a* proximate to the rivet 88. The slope $\beta$ of the sloped surfaces 126*a*, 128*a* may be, for example, between approximately 10 and 30 degrees, and is in this case approximately 20 degrees, relative to the bottom 122 of the channel or the bottom surface (in this view) of the soffit ramp 90*a*. Corners and intersections of surfaces may be rounded or chamfered as known by one of ordinary skill in the art.

Figure 12:
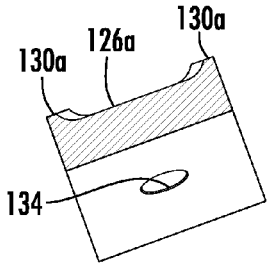
FIG. 12 is a section view of the soffit ramp of FIG. 9 taken along line 12-12 of FIG. 11.

FIG. 12 shows a section view of the sloped surface 126*a* of the first embodiment of a soffit ramp 90*a* described above; a section view of the other sloped surface 128*a* would be similar. As may be seen, the ridges 130*a*, 132*a* are symmetrical and the same size.

Figure 13:
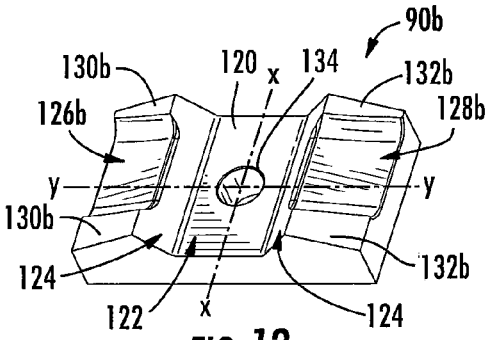
FIG. 13 is a perspective view of a second embodiment of a soffit ramp of the hold open arm assembly of FIG. 1.
Figure 14:
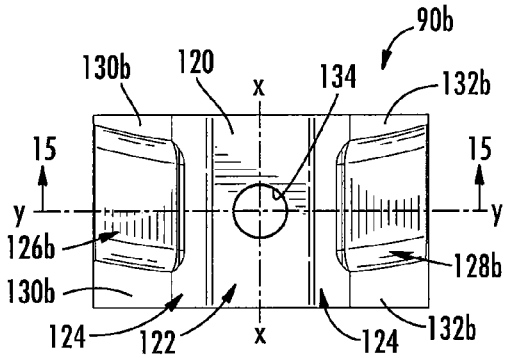
FIG. 14 is a top plan view of the soffit ramp of FIG. 13.

FIGS. 13 and 14 show a second embodiment of a soffit ramp 90*b*. This soffit ramp 90*b* is similar to the soffit ramp 90*a* of FIGS. 9 and 10, except that the sloped surfaces 126*b*, 128*b* and ridges 130*b*, 132*b* are not symmetrical about the major axis Y-Y, and are shaped to accommodate the sweep path of the plunger 86, with the arcs concave in the same direction.

Figure 15:
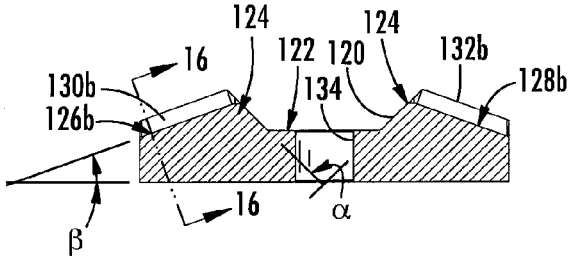
FIG. 15 is a section view of the soffit ramp of FIG. 13 taken along line 15-15 of FIG. 14.
Figure 16:
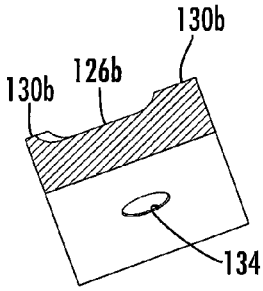
FIG. 16 is a section view of the soffit ramp of FIG. 13 taken along line 16-16 of FIG. 15.

FIG. 15 shows a section view of the soffit ramp 90*b*, similarly configured in this view to the soffit ramp 90*a* shown in FIG. 11. FIG. 16 shows a section view of the sloped surface 126*b* of the second embodiment of a soffit ramp 90*b* described above; a section view of the other sloped surface 128*b* would be a mirror image. The sloped surface 126*b* is offset from the major axis X-X, resulting in ridge 130*b* being wider at this location than ridge 132*b*.

While many dimensions are possible, the soffit ramps 90*a*, 90*b* may be, for example, about 1.3 inches along the major axis X-X and about 0.75 inches along the minor axis Y-Y. The thickness of the ridges 130*a*, 132*a*, 130*b*, 132*b* in top plan view may be, for example, 0.11 inches at their intersection with the minor axis Y-Y.

Figure 17:
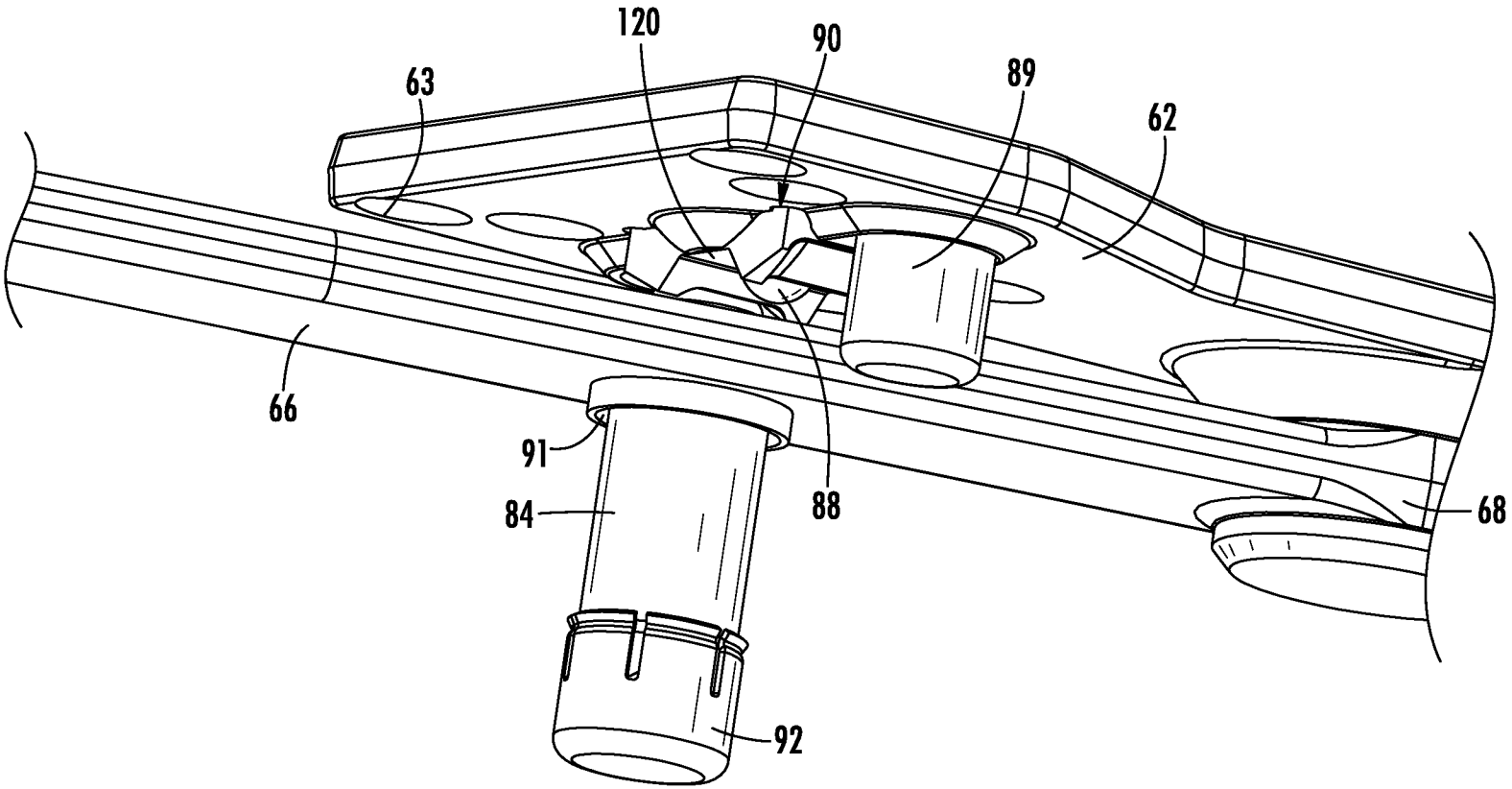
FIG. 17 is a detailed perspective view of a portion of the hold open arm assembly shown in FIG. 1.
Figure 18:
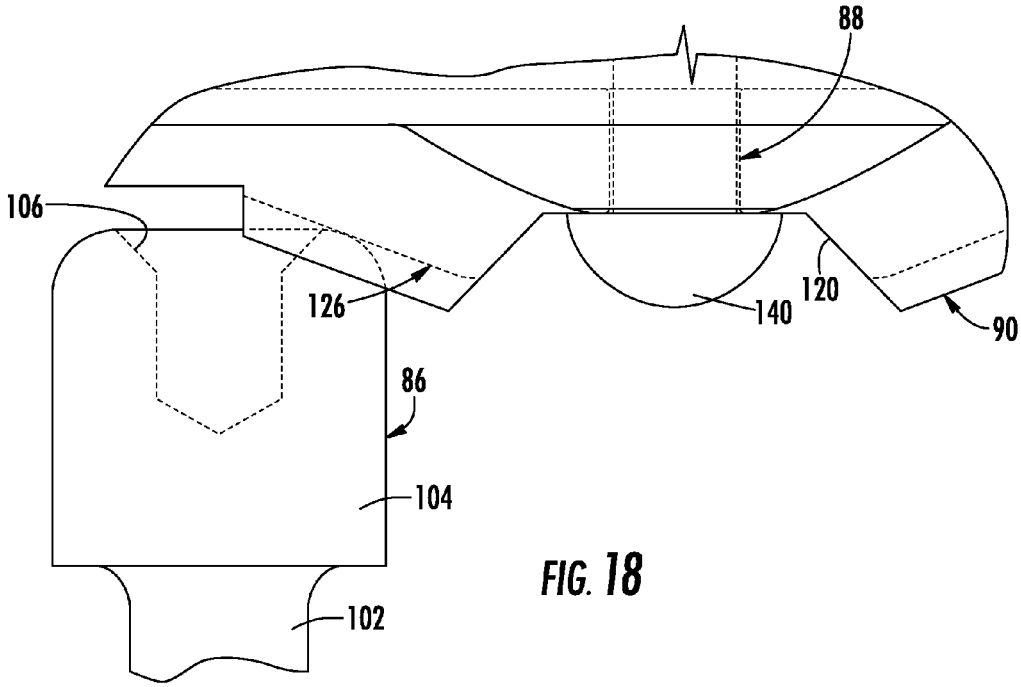
FIGS. 18-27 are a progression showing an embodiment of a soffit ramp and plunger in operation.
Figure 19:
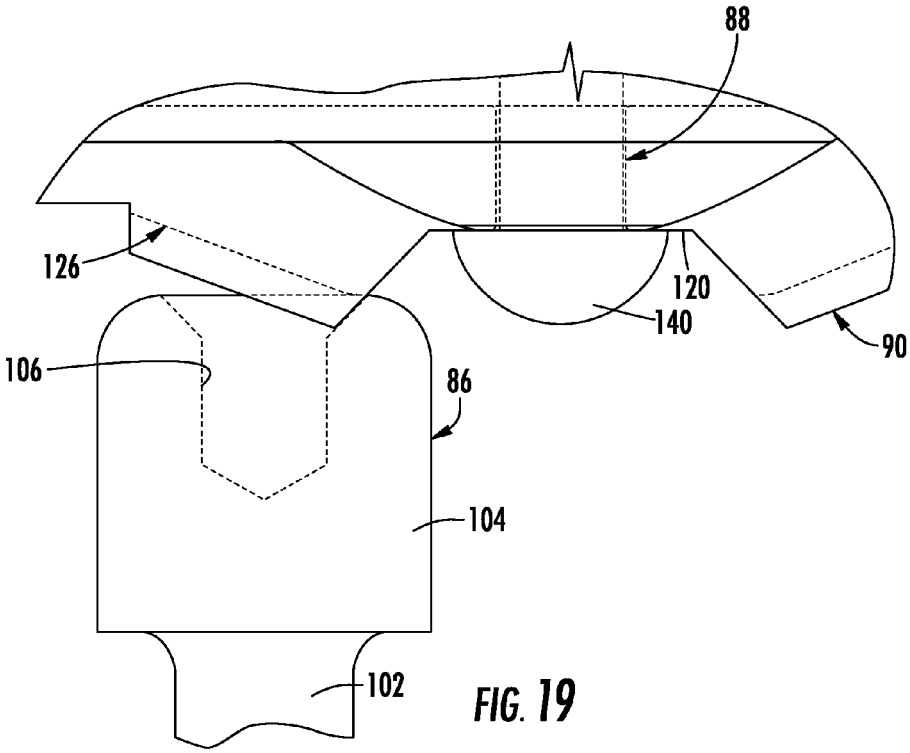
Figure 20:
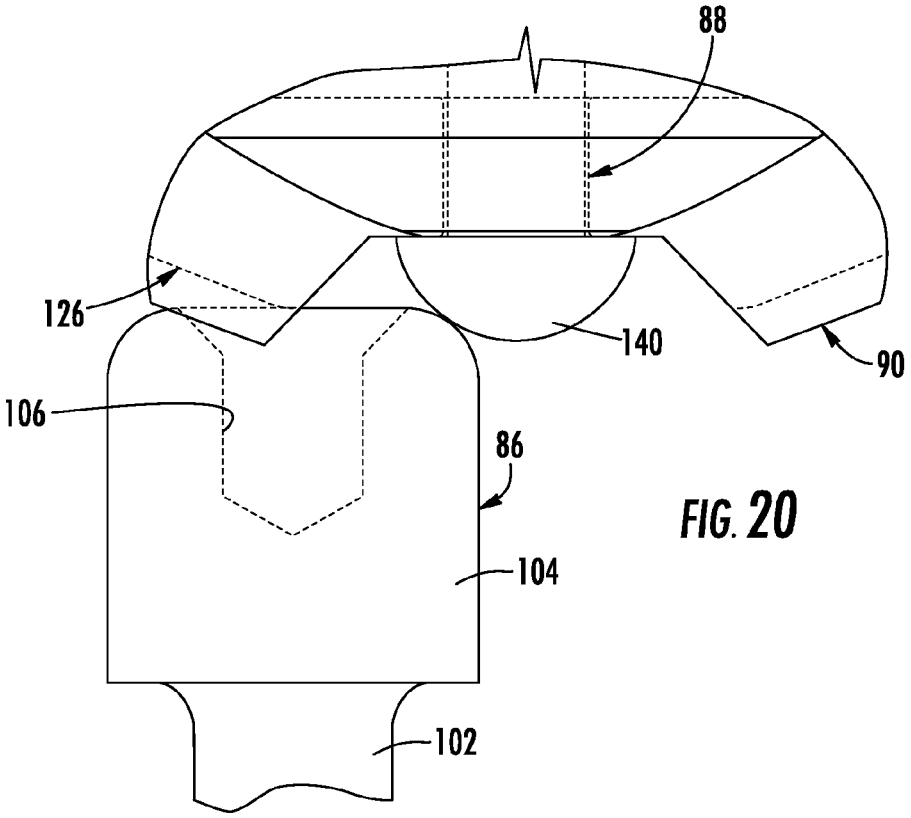

FIG. 17 shows the plunger 86 in the housing 84 approaching the soffit ramp 90. The head 140 of the rivet 88 may be seen in the channel 120 of the soffit ramp 90. The head 140 may be a domed or rounded, as in the button-head shape shown to facilitate sliding engagement with the plunger 86. A cylindrical stop is provided on the distal side of the soffit ramp 90 to prevent further opening of the door (not shown). The soffit ramp 90 is shown in operation in FIGS. 18-27, with the plunger 86 moving from left to right in the figures. In FIG. 18, the plunger 86 engages the sloped surface 126 of the ramp 90 and is moving toward the rivet 88. The plunger 86 travels along the sloped surface 126, with the plunger 86 being pressed downward. The right side of the enlarged end 104 of the plunger 86 has moved to the lower end of the sloped surface 126 in FIG. 19. FIG. 20 shows the right side of the enlarged end 104 engaging the head 140 of the rivet 88.

Because of the vertical displacement of the plunger 86 caused by the sloped surface 126, the plunger 86 engages the rivet 88 at a position on the head 140 of the rivet 88 where the rivet's surface is angled more towards horizontal than at a higher point on the rivet's head 140. This has the effect of reducing the horizontal force exerted by the plunger 86 on the rivet 88, which may help reduce or avoid premature failure of the parts, and serve to prolong their lives.

Figure 21:
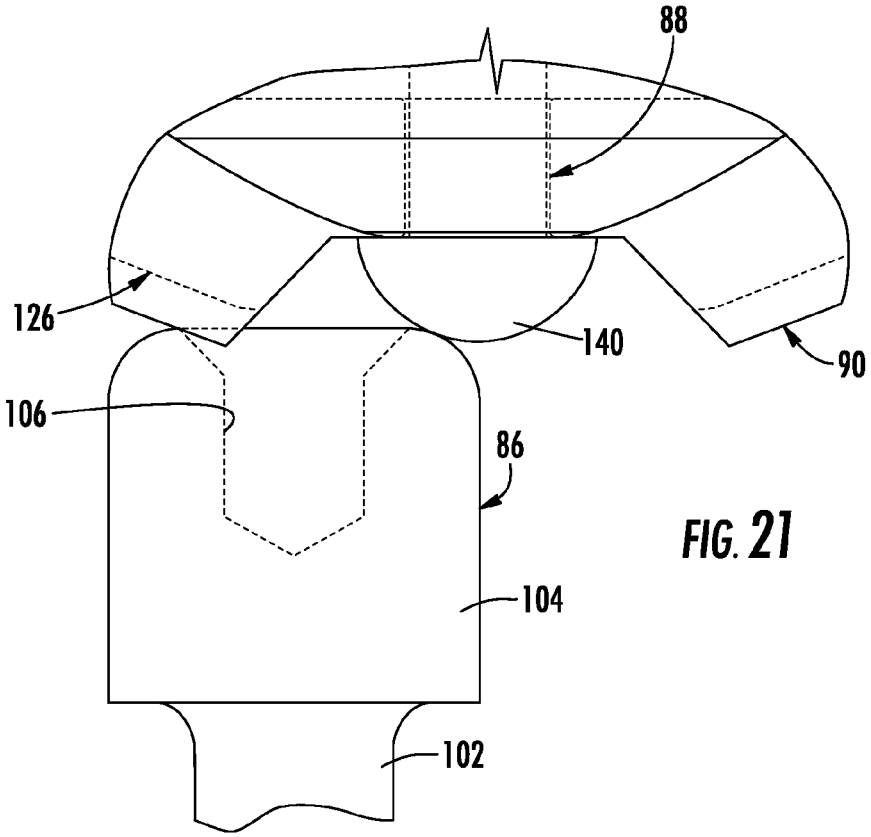
Figure 22:
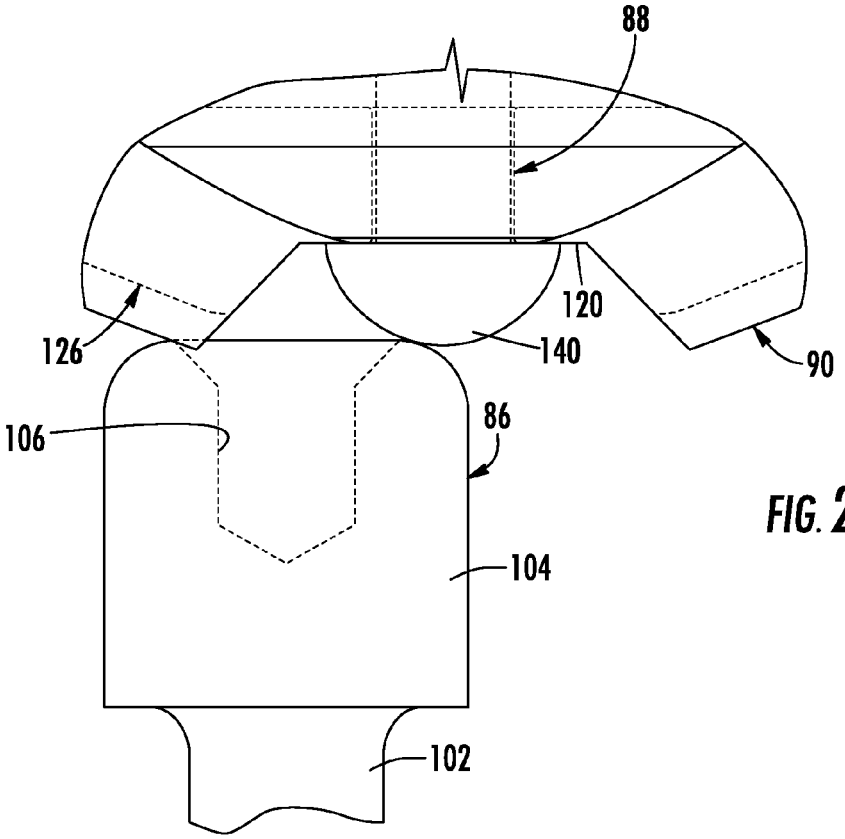
Figure 23:
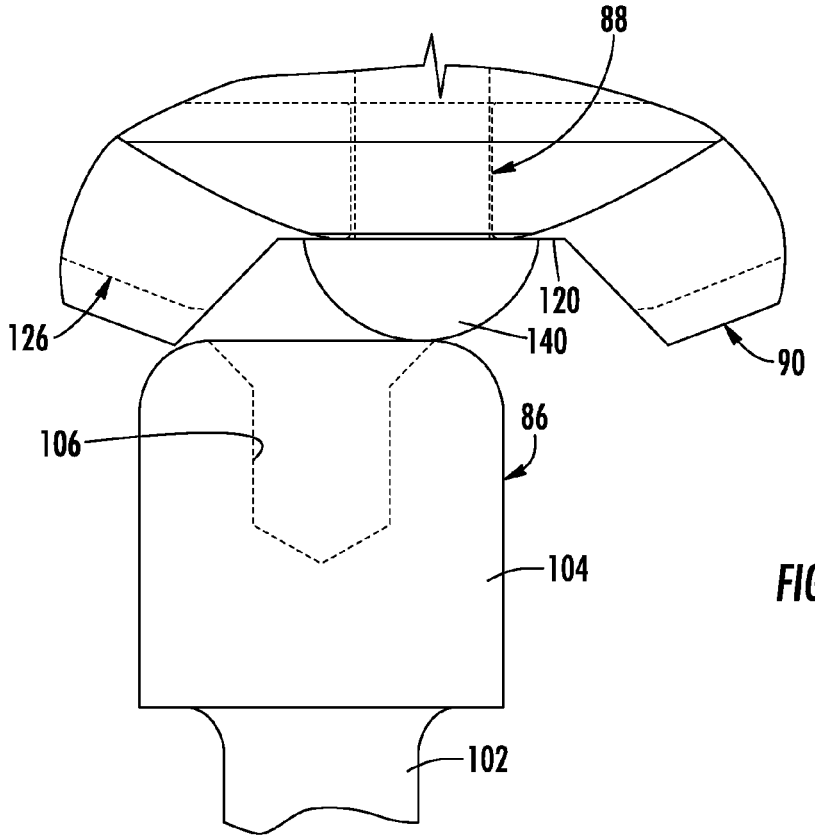
Figure 24:
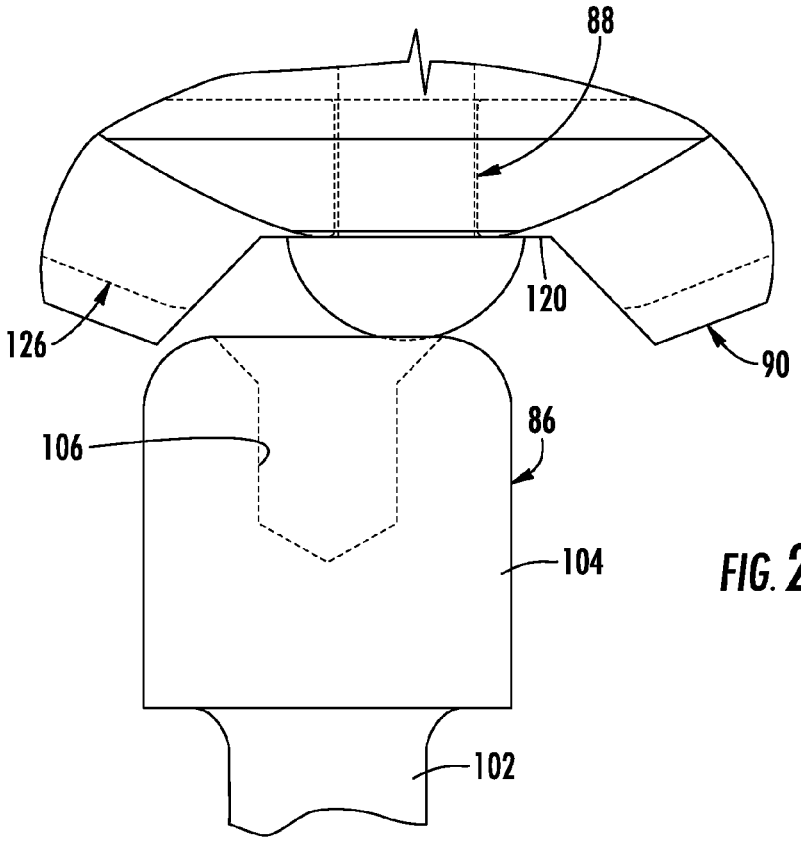
Figure 25:
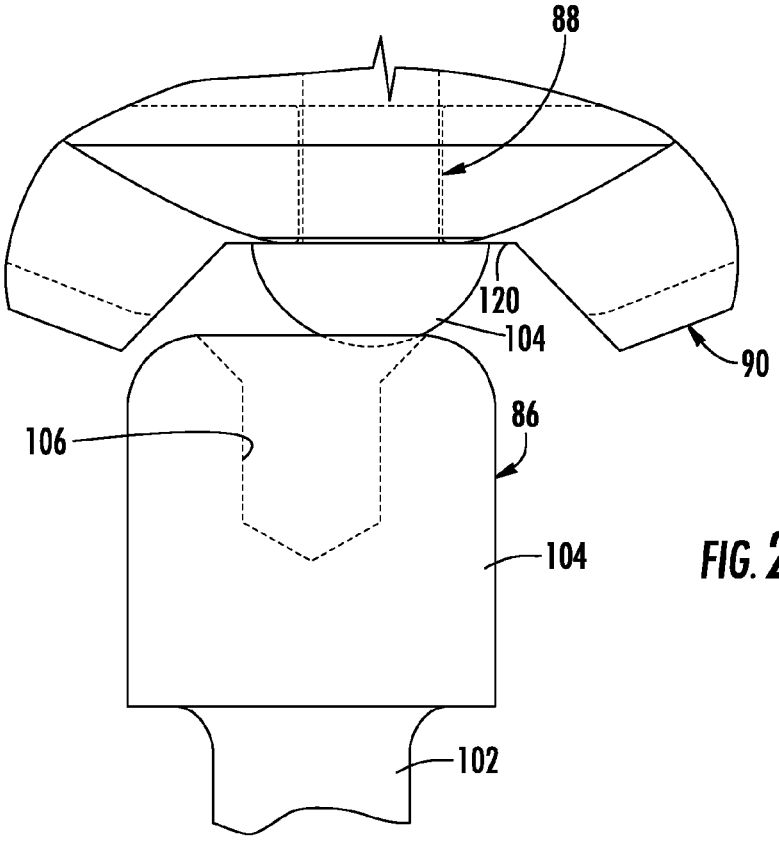
Figure 26:
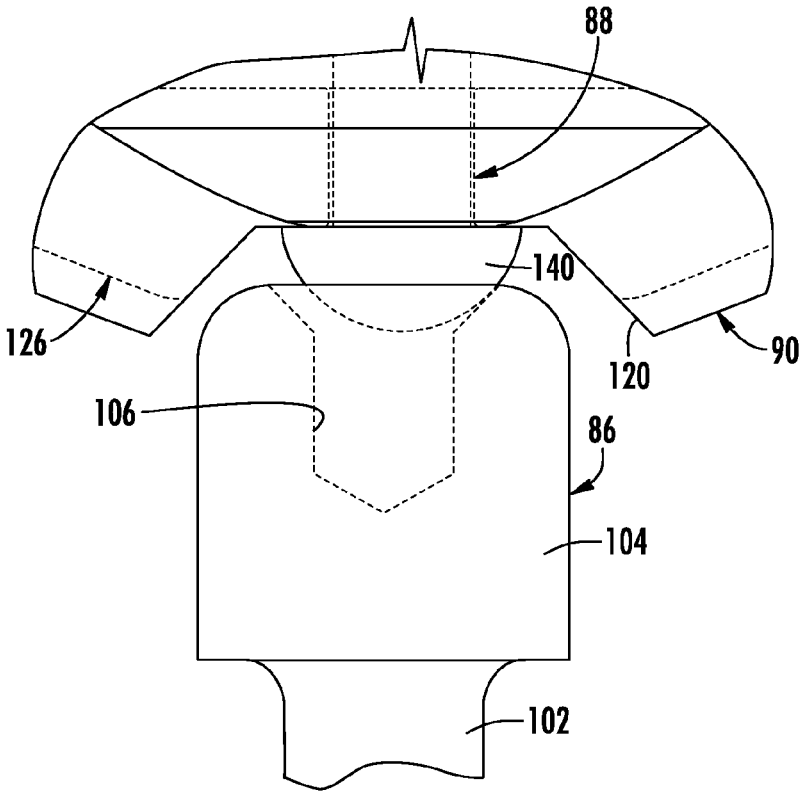
Figure 27:
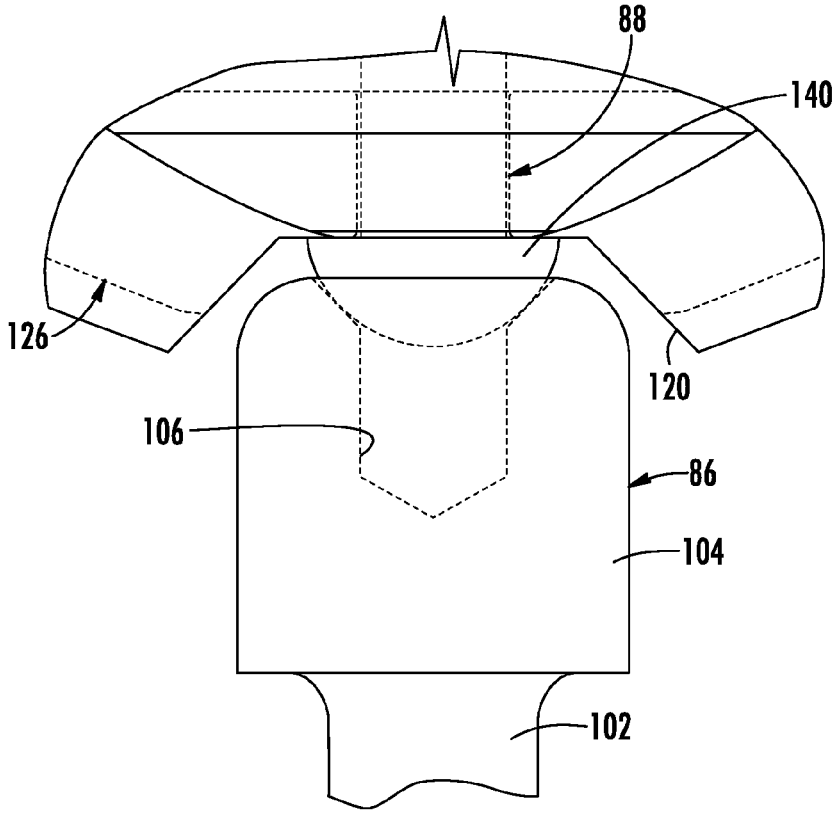

In FIG. 21, the right side of the enlarged end 104 of the plunger 86 is approaching the lowest point on the head 140 of the rivet 88, and the plunger 86 has separated from the sloped surface 126. FIG. 22 shows the plunger 86 immediately before reaching the lowest point on the rivet's head 140, and FIG. 23 shows the plunger 86 in that lowest position. FIGS. 24, 25, 26, and 27 progressively show the plunger 86 moving into position directly beneath the rivet 88, with the recessed area 106 in the enlarged end 104 of the plunger 86 receiving the head 140 of the rivet 88 as the plunger 86 moves to the right and upward. The shape of the recessed area 106 is sloped at the opening, like a funnel, to facilitate movement of the plunger 86 off of the head 140 when the door is to be closed and to provide a relatively tight fit with the head 140 as shown in FIG. 27.

The hold open arm assembly 50 in general may be made of conventional materials for such components, such as steel alloy. The soffit ramp 90 may be made of case hardened steel, such as, for example, AISI 8620 steel. Preferably, the soffit ramp 90 will have a carbon nitride surface hardness of Rc 55 to 60 equivalent, with 0.035 to 0.040 inches total effected depth. Also preferably, the grain in the steel will run along the length of the sloped surfaces 126*a*, 128*a*, 126*b*, 128*b* and have a surface finish of approximately 63 micro inches. Further preferably, no tool marks should be left on the soffit ramp's finished surface. As an alternative to being a separate component, the soffit ramp may be cast or forged as part of the soffit plate as a unitary construction, and preferably would be heat treated for hardening.

Although a rivet 88 is shown as the holding feature, other hardware could be used. For example, the holding feature could be a screw with a rounded head, or could be a staked-in ball bearing, with the ramp 90 configured to capture the ball bearing.

Although only a few exemplary embodiments have been shown and described in considerable detail herein, it should be understood by those skilled in the art that we do not intend to be limited to such embodiments since various modifications, omissions and additions may be made to the disclosed embodiments without materially departing from the novel teachings and advantages, particularly in light of the foregoing teachings. Accordingly, we intend to cover all such modifications, omission, additions and equivalents as may be included within the spirit and scope as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A hold open arm assembly for a door mounted to a door frame including a soffit, the door urged to close by a door closer mounted to the door, the assembly comprising:

a soffit plate substantially distributed about a major plane and adapted to be mounted to the soffit;

a holding feature including a head, the holding feature extending from the soffit plate such that the head extends substantially perpendicularly from the major plane; and a soffit ramp extending from the soffit plate in a direction away from the major plane and in a fixed position relative to the soffit plate, the soffit ramp providing a sloped surface laterally on at least one side of the head, and the distance from the sloped surface to the major plane is greatest proximate to the head, wherein at least a portion of the head extends beyond the soffit plate, wherein the portion is configured and positioned to engage a plunger.

2. The hold open arm assembly of claim 1, wherein the soffit ramp is adapted to be mounted to the soffit plate.

3. The hold open arm assembly of claim 1, wherein the angle between the sloped surface and the major plane is between approximately 10 degrees and approximately 30 degrees.

4. A hold open arm assembly for a door mounted to a door frame including a soffit, the door urged to close by a door closer mounted to the door, the assembly comprising:

a soffit plate substantially distributed about a major plane and adapted to be mounted to the soffit;

a holding feature including a head, the holding feature extending from the soffit plate such that the head extends substantially perpendicularly from the major plane; and a soffit ramp extending from the soffit plate in a direction away from the major plane and in a fixed position relative to the soffit plate, the soffit ramp providing a sloped surface laterally on at least one side of the head, and the distance from the sloped surface to the major plane is greatest proximate to the head, wherein the soffit ramp is of unitary construction with the soffit plate.

5. A hold open arm assembly for a door mounted to a door frame including a soffit, the door urged to close by a door closer mounted to the door, the assembly comprising:

a soffit plate substantially distributed about a major plane and adapted to be mounted to the soffit;

a holding feature including a head, the holding feature extending from the soffit plate such that the head extends substantially perpendicularly from the major plane; and a soffit ramp extending from the soffit plate in a direction away from the major plane and in a fixed position relative to the soffit plate, the soffit ramp providing a sloped surface laterally on at least one side of the head, and the distance from the sloped surface to the major plane is greatest proximate to the head, wherein the sloped surface is bounded by ridges on two sides that extend substantially along the slope.

6. The hold open arm assembly of claim 5, wherein the ridges are both convex relative to a point between the ridges.

7. The hold open arm assembly of claim 5, wherein one ridge is convex and one ridge is concave relative to a point between the ridges.

8. A method of operating a door, the door mounted to a door frame including a soffit and operatively connected to a door closer, a soffit plate mounted to the soffit, a first arm pivotally mounted to the soffit plate, a resiliently biased plunger mounted to the first arm and defining a recessed area in a free end, a second arm pivotally mounted to the first arm and to the door closer, a soffit ramp extending downward from the soffit plate, the soffit ramp including a sloped surface and a holding feature with a head adjacent to the sloped surface, the method comprising:

pushing the door open in a first direction until the plunger engages the sloped surface of the soffit ramp; and continuing to push the door in the first direction, causing the plunger to be increasingly depressed as the plunger slides along the sloped surface, until the plunger engages the head and receives the head in the recessed area to hold the door open.

9. The method of operating a door of claim 8, further comprising:

pushing the door in a second direction opposite the first direction to cause the plunger to be depressed by the head, release the head from the recessed area, and engage the sloped surface;

allowing the door closer to push the door in the second direction while the plunger slides along the sloped surface and the free end is increasingly higher until the plunger disengages the sloped surface; and allowing the door closer to continue to push the door in the second direction until the door is closed.

10. A hold open arm assembly for a door mounted to a door frame including a soffit, the door urged to close by a door closer mounted to the door, the assembly comprising:

a soffit plate substantially distributed about a major plane and adapted to be mounted to the soffit;

a holding feature including a head, the holding feature extending from the soffit plate such that the head extends substantially perpendicularly from the major plane;

a soffit ramp extending from the soffit plate in a direction away from the major plane and in a fixed position relative to the soffit plate, the soffit ramp providing a sloped surface laterally on at least one side of the head, and the distance from the sloped surface to the major plane is greatest proximate to the head;

a first arm member having a longitudinal axis and including a proximal end and a distal end, the proximal end of the first arm member pivotally mounted to the soffit plate;

a housing mounted to the first arm member; and a resiliently biased plunger having a free end and received in the housing, the plunger extending substantially perpendicularly to the longitudinal axis and defining a recessed area in the free end, wherein when the first arm member pivots relative to the soffit plate and the plunger approaches the head, the plunger engages the sloped surface of the soffit ramp, slides along the sloped surface toward the head, and receives at least a portion of the head in the recessed area in the free end.

11. The hold open arm assembly of claim 10, wherein the soffit ramp provides sloped surfaces laterally on two sides of the head and is adapted to accept the plunger from two directions corresponding to the two sloped surfaces.

12. The hold open arm assembly of claim 10, further comprising:

a second arm member including a proximal end and a distal end, the proximal end of the second arm member pivotally mounted to the distal end of the first arm member and the distal end of the second arm member adapted to be pivotally mounted to the door closer.

13. A hold open arm assembly for a door mounted to a door frame including a soffit, the door urged to close by a door closer mounted to the door, the assembly comprising:

a soffit plate substantially distributed about a major plane and adapted to be mounted to the soffit;

a holding feature including a head, the holding feature extending from the soffit plate such that the head extends substantially perpendicularly from the major plane; and a soffit ramp extending from the soffit plate in a direction away from the major plane and in a fixed position relative to the soffit plate, the soffit ramp providing a sloped surface laterally on at least one side of the head, and the distance from the sloped surface to the major plane is greatest proximate to the head, wherein the soffit ramp comprises a body distributed around first, second, and third perpendicular, intersecting axes, including:

a first surface substantially distributed around a plane that includes the first and second axes;

a second surface opposite the first surface, the distance between the first and second surfaces parallel to the third axis defining a thickness, the second surface defining a channel extending substantially along the first axis, the channel including a wall on each side and a bottom, wherein the sloped surface is a first sloped surface extending generally in the alignment of the second axis on a first side of the channel from the periphery of the body proximate to the first surface where the thickness is relatively small, to the wall of the channel where the thickness of the body is relatively large.

14. The hold open arm assembly of claim 13, wherein the body is adapted to be mounted to the soffit plate, with the first surface contacting the soffit plate.

15. The hold open arm assembly of claim 13, wherein the body is of unitary construction with the soffit plate.

16. The hold open arm assembly of claim 13, wherein the body defines an opening through the bottom of the channel adapted to receive the holding feature substantially parallel to or along the third axis.

17. The hold open arm assembly of claim 16, wherein the holding feature is a rivet including a substantially rounded head.

18. The hold open arm assembly of claim 13, further comprising a second sloped surface extending generally in the alignment of the second axis on a second side of the channel from the periphery of the body proximate to the first surface where the thickness is relatively small, to the wall of the channel where the thickness of the body is relatively large.

19. The hold open arm assembly of claim 18, wherein the soffit ramp is adapted to accept a plunger from two directions corresponding to the first and second sloped surfaces.

20. The hold open arm assembly of claim 13, wherein the first sloped surface is bounded by ridges on two sides that do not cross the second axis.

21. The hold open arm assembly of claim 20, wherein the ridges are convex relative to the second axis.

22. The hold open arm assembly of claim 20, wherein one ridge is convex and one ridge is concave relative to the second axis.

23. The hold open arm assembly of claim 13, wherein the angle between the sloped surface and the plane that includes the first and second axes, when measured on the alignment of the second axis, is between approximately 10 degrees and approximately 30 degrees.

* * * * *